US006275676B1

(12) United States Patent
Ushio

(10) Patent No.: US 6,275,676 B1
(45) **Date of Patent: *Aug. 14, 2001**

(54) DUPLEX IMAGE FORMING APPARATUS WITH SHEET INTERVAL SELECTION MEANS

(75) Inventor: Kenji Ushio, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/112,460

(22) Filed: Jul. 9, 1998

(30) Foreign Application Priority Data

Jul. 14, 1997 (JP) ..... 9-188123

(51) Int. Cl.[7] ..... G03G 15/00

(52) U.S. Cl. ..... 399/401; 271/65; 271/186; 271/301; 399/402

(58) Field of Search ..... 399/401, 402; 271/3.03, 65, 186, 301

(56) References Cited

U.S. PATENT DOCUMENTS

| | | | | |
|---|---|---|---|---|
| 4,935,786 | * | 6/1990 | Veeder | 399/401 |
| 5,225,881 | * | 7/1993 | Goto et al. | 399/402 |
| 5,337,135 | * | 8/1994 | Malachowski et al. | 399/401 |
| 5,347,351 | | 9/1994 | Morita et al. | 399/374 |
| 5,557,391 | | 9/1996 | Kato et al. | 399/401 |
| 5,893,020 | * | 4/1999 | Atsumi | 399/401 |

FOREIGN PATENT DOCUMENTS

| | | |
|---|---|---|
| 0 602 661 | 6/1994 | (EP) . |
| 60-063561 | 4/1985 | (JP) . |
| 60-181757 | 9/1985 | (JP) . |
| 63-300247 | 12/1988 | (JP) . |
| 9-297433 | 11/1997 | (JP) . |
| 10-039559 | 2/1998 | (JP) . |

OTHER PUBLICATIONS

European Search Report.

* cited by examiner

*Primary Examiner*—Arthur T. Grimley
*Assistant Examiner*—William A. Noe
(74) *Attorney, Agent, or Firm*—Fitzpatrick, Cella, Harper & Scinto

(57) ABSTRACT

The present invention provides an image forming apparatus having an electrophotographic image forming means for fixing a toner image formed on a sheet to the sheet by heating the toner image, wherein an interval between the sheets when the sheets are continuously sent to the image forming means to form images on both surfaces of plural sheets is selected to become smaller than an interval between the sheets when the sheets are continuously sent to the image forming means to form images on one surfaces of the plural sheets.

6 Claims, 5 Drawing Sheets

DUPLEX IMAGE FORMING APPARATUS WITH SHEET INTERVAL SELECTION MEANS

BACKGROUND OF THE INVENTION

1. Field of the Invention

The present invention relates to an image forming apparatus such as a copying machine, a printer or the like, and more particularly it relates to an image forming apparatus in which productivity is improved when images are recorded on recording sheets by several times.

2. Related Background Art

Productivity (index for indicating the number of recordable copies per unit time) which is one of performances of an image forming apparatus such as a copying machine is generally determined by a process speed and a conveying distance (interval) between recording sheets.

The process speed is a conveying speed for the recording sheet in an image forming part. The conveying interval of the recording sheet is a distance between a trailing end of a preceding recording sheet and a leading end of a succeeding sheet when images are formed continuously. That is to say, the productivity of the copying machine can be improved by increasing the process speed or by decreasing the conveying interval.

However, the process speed greatly depends upon a processing ability of the image forming part. Accordingly, in order to increase the process speed, an image forming apparatus having a high speed processing ability must be adopted or developed, which leads in increase in the manufacturing cost and which is difficult to realize quickly.

In order to decrease the conveying interval of the recording sheet, there is a danger of arising the following problems.

In case of an image forming apparatus of electrophotographic type, an image is fixed to a recording sheet by heating toner transferred to the recording sheet by means of a fixing device. If the conveying interval is decreased, since the number of recording sheets fixed per unit time is increased, a greater amount of heat is absorbed from the fixing device. As a result, the recording sheet cannot be heated sufficiently, thereby causing poor toner fixing.

On the other hand, in case of an image forming apparatus having a first page processing function, a rear surface discharge mode in which recording sheets on which the images were formed are turned up or reversed and then are stacked on a discharge tray is used. In this case, when a switch-back system in which the recording sheet is temporarily into a reverse path is used as a recording sheet reversing system, since the succeeding recording sheet cannot be conveyed until the preceding recording sheet is discharged from the reverse path, a predetermined conveying interval is required.

Further, in a case where a retard system in which sheets are supplied one by one by means of a supply roller and friction of a separation roller is used, in an area where the sheet is conveyed only by the supply roller and the separation roller, a conveying speed of the recording sheet becomes unstable. Thus, the conveying interval must be increased accordingly.

SUMMARY OF THE INVENTION

Due to the above limitations, the conveying interval cannot merely be decreased, and, thus, it is difficult to improve the productivity by decreasing the conveying interval. In consideration of this, an object of the present invention is to provide an image forming apparatus in which a conveying interval can be decreased regardless of the above limitations thereby to improve productivity.

To achieve the above object, the present invention provides an image forming apparatus having an electrophotographic image forming means for fixing a toner image formed on a sheet to the sheet by heating the toner image, wherein an interval between the sheets when the sheets are continuously sent to the image forming means to form images on both surfaces of plural sheets is selected to become smaller than an interval between the sheets when the sheets are continuously sent to the image forming means to form images on one surfaces of the plural sheets.

Further, the image forming apparatus may comprise a sheet supply means for feeding out the sheet from a sheet containing part, and a re-convey means for returning the sheet on which the image was formed by the image forming means to the image forming means to form the image on the sheet again, and, in the image forming apparatus, when the image is formed on one surface of the sheet, the sheet is fed out from the sheet supply means, and, when the images are formed on both surfaces of the sheet, the sheet is sent to the image forming means again through the re-convey means.

DETAILED DESCRIPTION OF THE PREFERRED EMBODIMENTS

Figure 1:
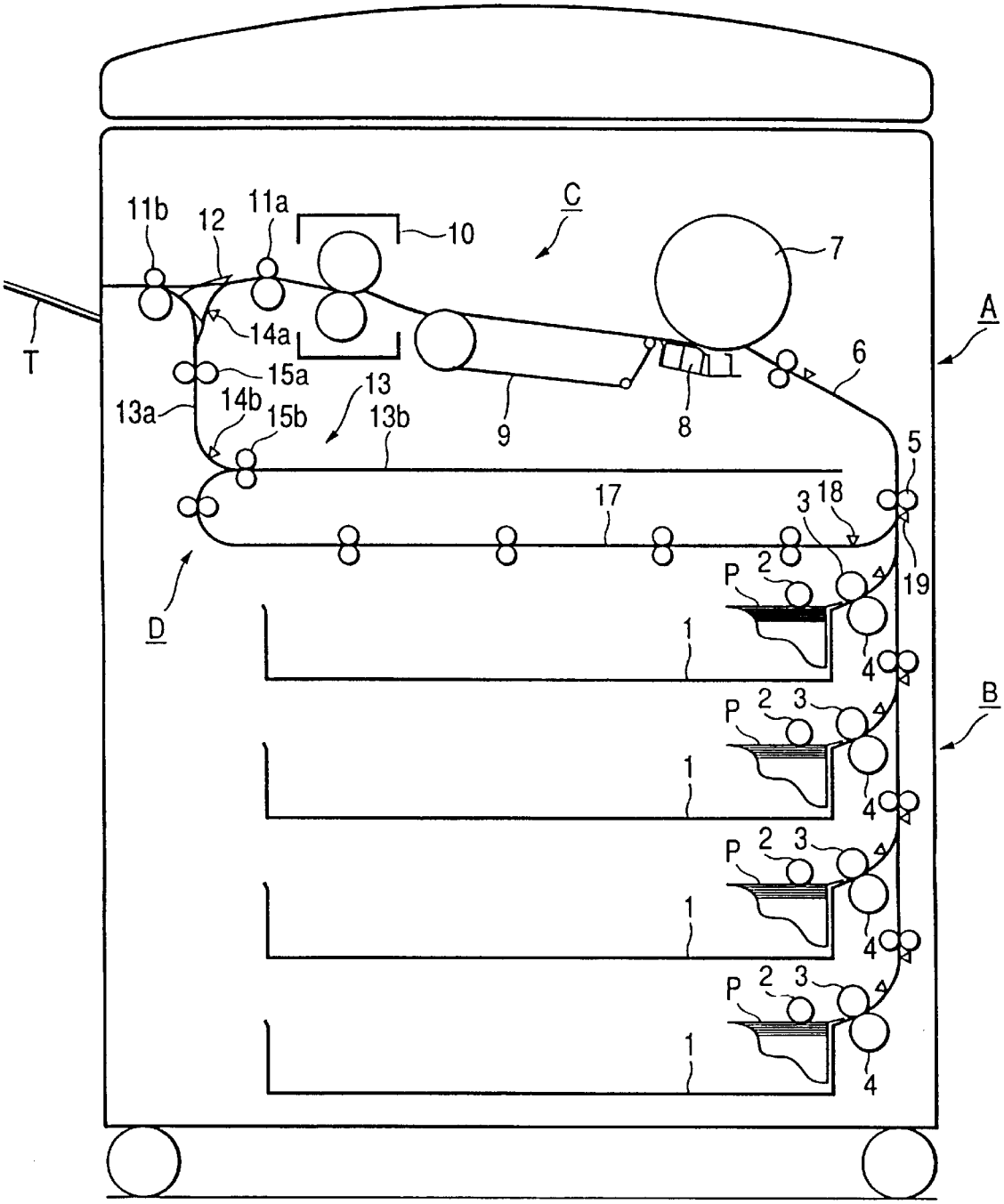
FIG. 1 is a sectional view of an entire image forming apparatus according to the present invention.
Figure 2:
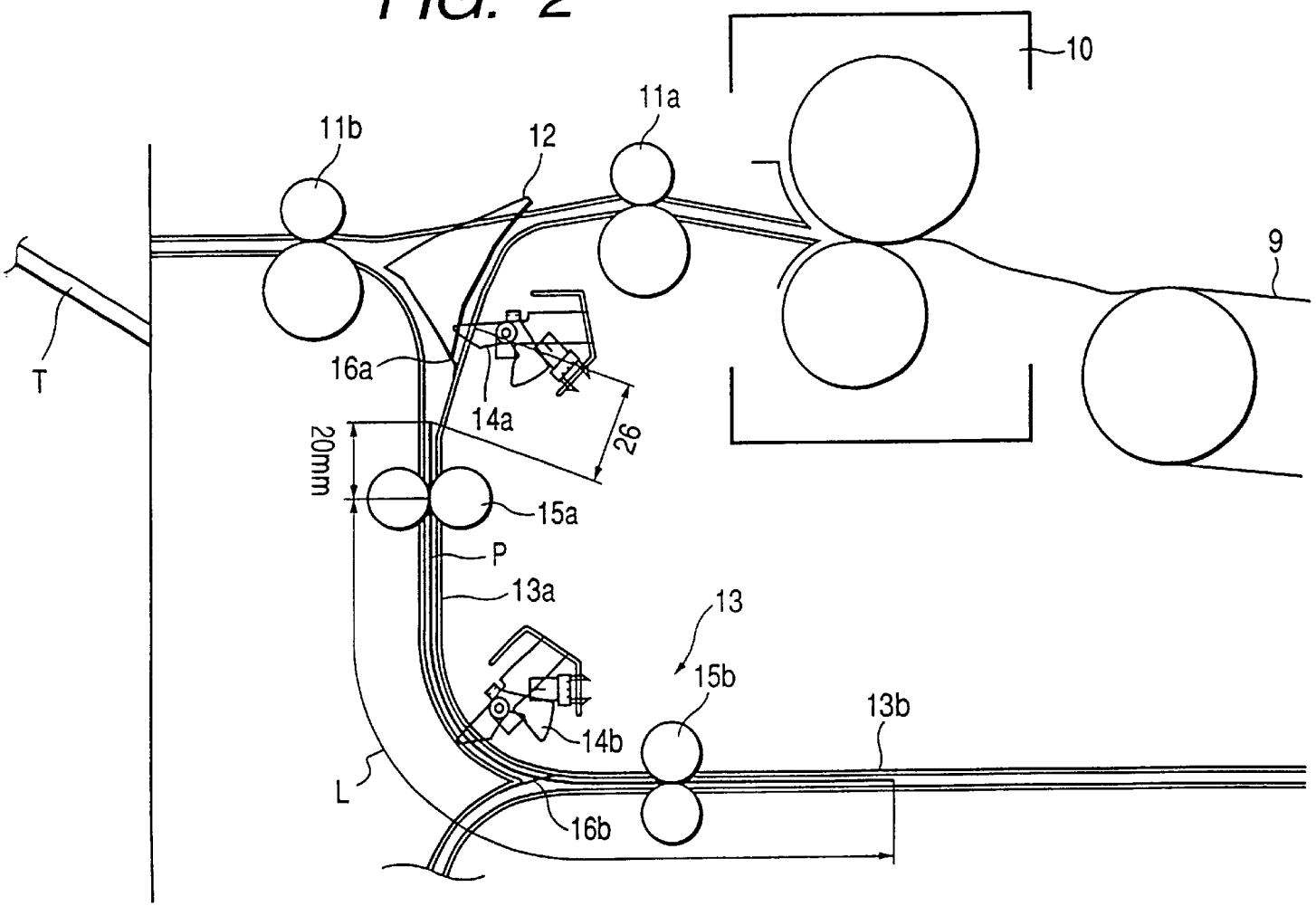
FIG. 2 is a view showing a reverse part of the image forming apparatus for explaining rear surface discharge.
Figure 3:
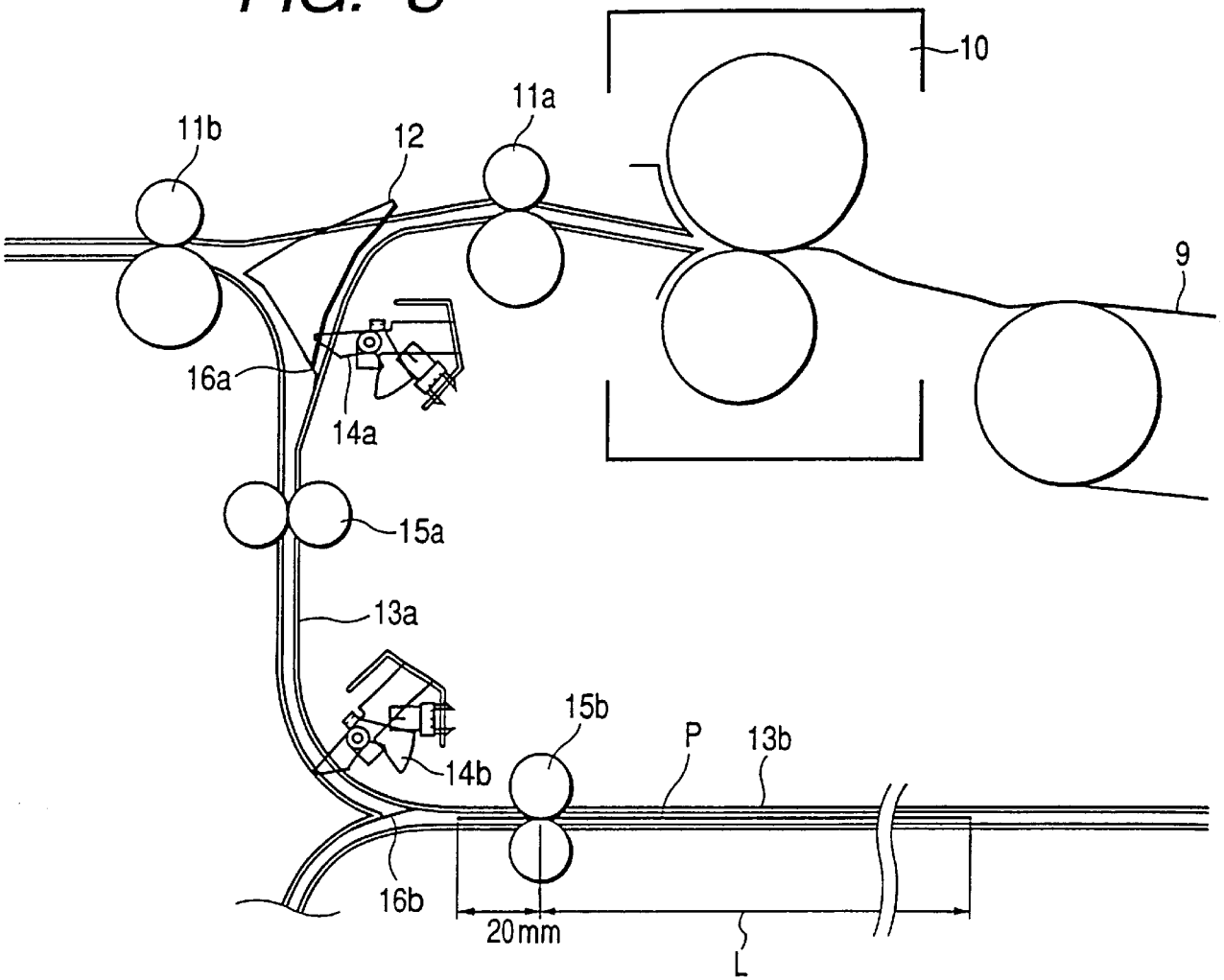
FIG. 3 is a view showing the reverse part of the image forming apparatus for explaining re-convey.
Figure 4:
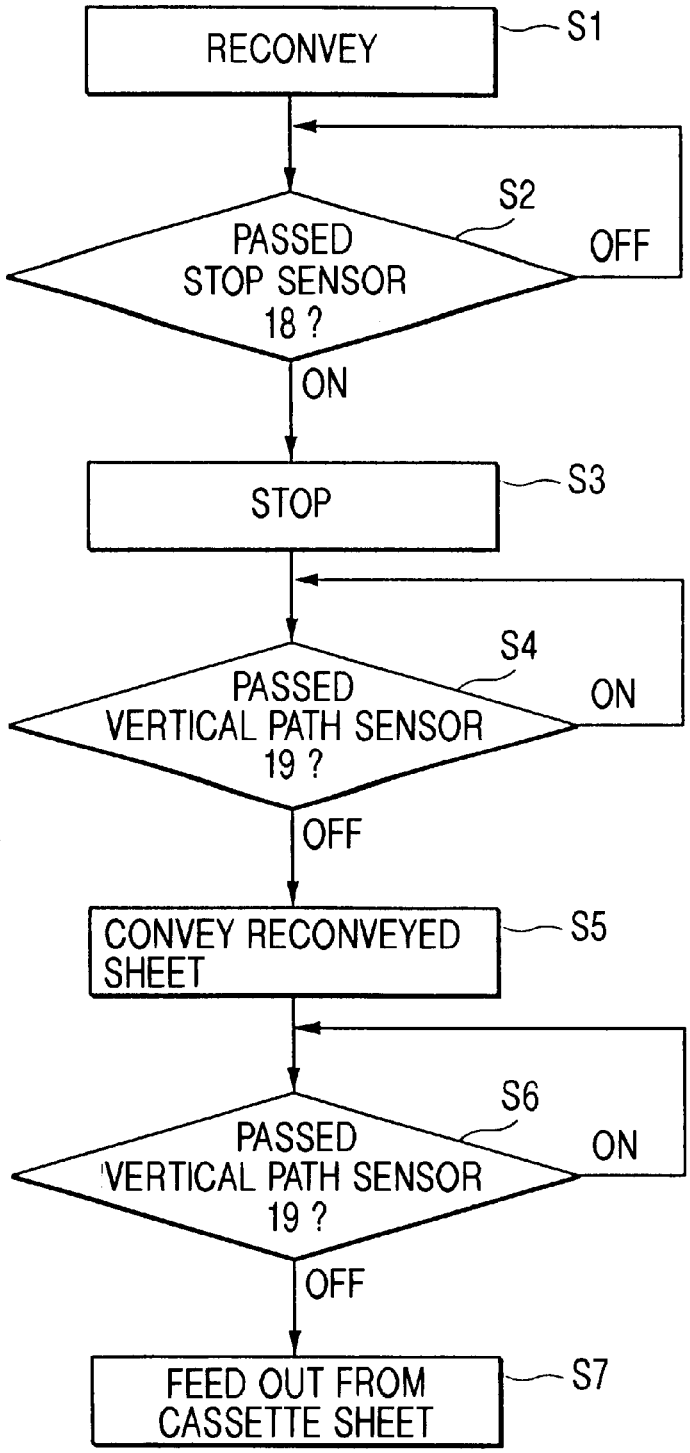
FIG. 4 is a flow chart for explaining timings for feeding out a recording sheet and a re-conveyed sheet.
Figure 5A:
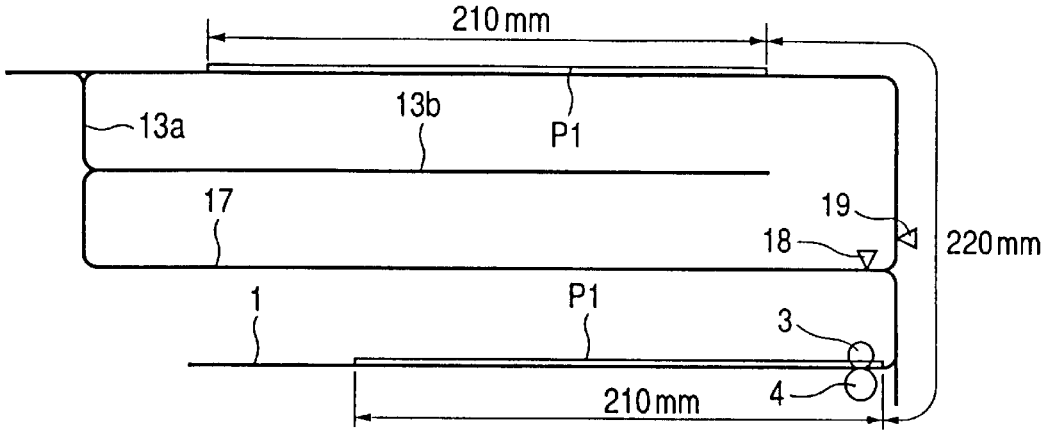
FIGS. 5A, 5B and 5C are views for explaining a conveying interval.
Figure 5B:
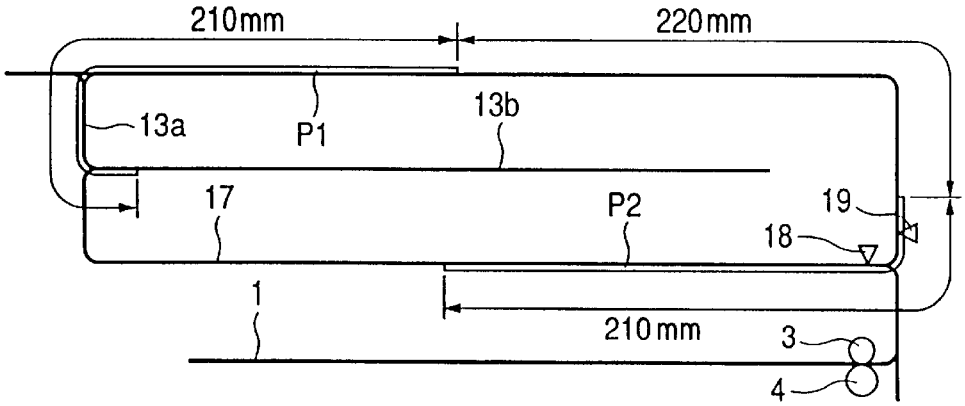
Figure 5C:
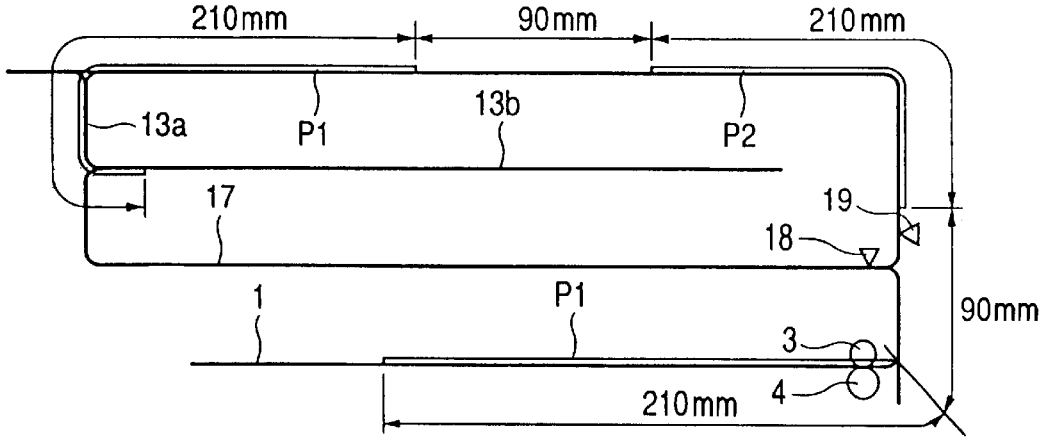

Now, an image forming apparatus according to a preferred embodiment of the present invention will be explained with reference to the accompanying drawings. FIG. 1 is a sectional view of an entire image forming apparatus according to the present invention, FIG. 2 is a view showing a reverse part of the image forming apparatus for explaining rear surface discharge, FIG. 3 is a view showing the reverse part of the image forming apparatus for explaining re-convey, FIG. 4 is a flow chart for explaining timings for feeding out a recording sheet and a re-conveying sheet, and FIGS. 5A to 5C are views for explaining a conveying interval.

The image forming apparatus A shown in FIG. 1 is a digital copying machine in which an image forming means C is disposed at an upper part and a plurality of cassettes 1 for stacking recording sheets P are mounted at a lower part. A supply means B is associated with each of the cassettes 1 to convey the recording sheet P to the image forming means C.

A re-convey means D is connected to the image forming means C so that the recording sheet P having a first surface on which an image was formed by the image forming means C can be subjected to reverse of front/rear surface and then be discharged or re-supplied. Incidentally, by discharging the recording sheet P while reversing front/rear surface, the recording sheets can be stacked in a page sequence (page order). This is referred to as "first page processing function".

On the other hand, a system in which, after the recording sheet is reversed, the recording sheet is re-supplied from the supply means B to a convey path for the image forming means C is referred to as "through-path both surface system".

[Supply means]

A pick-up roller 2 is urged against the recording sheets P stacked on each cassette 1 so that an uppermost recording sheet P can be fed out. The supply means is of retard type, and double-feed of the recording sheets P is prevented by supply rollers 3 driven in a recording sheet conveying direction and separation rollers 4 rotated in an opposite direction.

The separated recording sheet P is brought to a supply path 6 by a corresponding pair of convey rollers 5 and then is fed out to the image forming means C of electrophotographic type.

[Image forming means]

In the image forming means C, an electrostatic latent image is formed on a photosensitive drum 7 in response to an image signal emitted from a computer (not shown), and the latent image is visualized as a toner image. The toner image formed on the photosensitive drum 7 is transferred, by a transfer charger 8, onto the recording sheet P between the photosensitive drum 7 and the transfer charger 8. The recording sheet P is supplied by the supply means B in a timed relation to the photosensitive drum 7.

The recording sheet P to which the image was transferred is fed out, by a convey belt 9, to a fixing device 10, where the toner image is fixed to the recording sheet by heat and pressure. After the fixing, the recording sheet is sent to the re-convey means D through a first pair of discharge rollers 11*a*, and is discharged out of the apparatus by a second pair of discharge rollers 11*b* or re-supplied while reversing front/rear surface.

[Re-convey means]

In the re-convey means D, a flapper 12 for switching an advancing direction of the recording sheet P is disposed between the first pair of discharge rollers 11*a* and the second pair of discharge rollers 11*b*, so that the recording sheet P conveyed by the first pair of discharge rollers 11*a* can be directed to a switch-back path 13. The switch-back path 13 is branched on the way to a downward path connected to a lower convey path 17. Hereinafter, a path of the switch-back path 13 disposed toward the flapper 12 from the branched position is referred to as "switch-back path 13*a*" and the other path of the switch-back path 13 is referred to as "switch-back path 13*b*".

As shown in FIG. 2, a first valve 16*a* is attached to a lower portion of the flapper 12, which valve is disposed in a convey path from the first pair of discharge rollers 11*a* to the switch-back path 13*a*. With this arrangement, the recording sheet P is prevented from returning from the switch-back path 13*a* to the first pair of discharge rollers 11*a*. Further, a second valve 16*b* is disposed at the branched position between the switch-back paths 13*a* and 13*b*, so that, as shown in FIG. 3, the recording sheet P fed out from the switch-back path 13*b* is directed to the lower convey path 17. The lower convey path 17 is connected to the supply path 6 for feeding the sheet from the supply means B to the image forming means C.

[Reversing operation]

In the image forming apparatus having the above-mentioned arrangement, when the image is recorded only one surface of the recording sheet P, first of all, by the action of the flapper 12, the recording sheet P is fed out to the switch-back path 13*a*. When a predetermined time period is elapsed after the trail end of the recording sheet P is detected by a reverse sensor 14*a*, a switch-back roller 15*a* is rotated in a reverse direction. Consequently, under the action of the first valve 16*a*, the recording sheet P is directed to the second pair of discharge rollers 11*b*, with the result that the recording sheet is discharged onto a tray T out of the apparatus while reversing front/rear surface.

When the images are recorded on both surfaces of the recording sheet P, after the fact that the recording sheet P was contained in the switch-back path 13*b* is detected by a reverse sensor 14*b*, a switch-back roller 15*b* is driven in a reverse direction. Consequently, under the action of the valve 16*b*, the recording sheet P is fed out to the lower convey path 17 and then is directed to the image forming means C through the supply path 6. After the image is recorded on the rear surface of the recording sheet, the recording sheet is directly discharged onto the tray T out of the apparatus through the first and second pairs of discharge rollers 11*a*, 11*b*, since the front/rear surface of the sheet was already effected.

Now, feeding of the recording sheet will be explained. In this case, the recording sheet fed out from the cassette 1 is referred to as "recording sheet P1" and the recording sheet re-conveyed from the lower convey path 17 is referred to as "recording sheet P2".

When the images are recorded continuously, as shown in the flow chart of FIG. 4, the re-conveyed sheet P2 which is re-conveyed (step S1) is temporarily stopped (step S3) when the leading end of the sheet is detected by a stop sensor 18 (step S2). When the trailing end of a recording sheet P1 newly fed out from the cassette 1 is detected by a vertical path sensor 19 (step S4), conveyance of the re-conveyed sheet P2 in the lower convey path 17 is re-started (step S5). Further, when the trail end of the re-conveyed sheet P2 is detected by the vertical path sensor 19 (step S6), a new recording sheet P1 is fed out from the cassette 1 (step S7). Such a cycle is repeated.

[Productivity]

Next, the productivity of image recording will be explained with reference to FIGS. 5A to 5C while comparing with the conventional case. In the illustrated embodiment, it is assumed that a conveying speed V of the recording sheet P1 is 300 mm/s and a standard size of the recording sheet P1 is A4 (length in the conveying direction=210 mm).

First of all, a case where the image is recorded on one surface of the sheet and the sheet is discharged while reversing front/rear surface (first page processing) will be explained with reference to FIGS. 2 and 5A. In the fixing device 10, after the fixing operation was finished, the recording sheet P1 enters into the switch-back path 13*a*. After the trail end of the sheet is detected by the reverse sensor 14*a*, the sheet is conveyed by 26 mm and is stopped there. In this case, a distance between the trail end of the recording sheet P1 and the switch-back roller 15*a* becomes 20 mm.

Immediately after the stoppage of the recording sheet, the switch-back rollers 15*a*, 15*b* are rotated in the reverse direction, thereby discharging the recording sheet P1 out of the apparatus. In this case, a time period required for separating the recording sheet P1 from the switch-back roller 15*a* becomes.

$$L/V=(210\ [\mathrm{mm}]-20\ [\mathrm{mm}])/300\ [\mathrm{mm/s}]=0.63\ [\mathrm{s}].$$

Thus, the time period is at least 0.63 second. In actuality, margin is required to allow for poor conveyance. It is assumed that the margin is 30 mm, the required time period becomes $$L/V=(210\ [\mathrm{mm}]+30\ [\mathrm{mm}]-20\ [\mathrm{mm}])/(300\ [\mathrm{mm/s}])=0.73\ [\mathrm{s}].$$

In this case, the conveying interval becomes $$210\ [\mathrm{mm}]+30\ [\mathrm{mm}]-20\ [\mathrm{mm}]=220\ [\mathrm{mm}].$$

In this case, in consideration of the length of the recording sheet P1 itself, the productivity becomes $$300\ [\mathrm{mm/s}]\times 60\ [\mathrm{s}]/(210\ [\mathrm{mm}]+220\ [\mathrm{mm}])=42\ [\mathrm{sheets/min}].$$

Further, as shown in FIG. 5B, in the conventional case, even when the images are formed on both surfaces of the re-conveyed sheet P2, the conveying interval was set to be equal to that in the one surface recording. Accordingly, in this case, the productivity became $$42\ [\mathrm{sheets/s}]/2[\mathrm{surfaces}]=21\ [\mathrm{sheets/min}].$$

By the way, in the rear surface recording of the reversed and re-conveyed sheet, since the recording sheet P2 was once passed through the fixing device 10, the sheet was already heated in comparison with the recording sheet P1 fed out from the cassette. Thus, since a heat amount of the recording sheet P2 absorbing from the fixing device 10 is smaller than that of the recording sheet P1, the conveying interval can be reduced.

Further, when the images are recorded on both surfaces of the recording sheet continuously, the recording sheet P1 having the front surface on which the image is to be recorded and the recording sheet P2 having the rear surface on which the image is to be recorded are supplied alternately. In this case, when the image is recorded on the rear surface, since the recording sheet is not reversed by the re-convey means D, the time period required for the reversal does not relate to determination of the conveying interval, and, thus, the conveying interval can be reduced.

Further, since the recording sheets are supplied alternately, regarding the recording sheet P1 newly supplied from the cassette 1, there is the conveying interval corresponding to at least the length of the re-conveyed sheet P2. Accordingly, even if the conveying speed for the recording sheet P1 is not stable at the region where the recording sheet is conveyed only by the supply roller 3 and the separation roller 4, it is not required to increase the conveying interval accordingly, thereby decreasing the conveying interval.

In the illustrated embodiment, as shown in FIG. 5C, in the both surface recording, the conveying interval is decreased as much as possible. In consideration of the remaining factor for determining the conveying interval (poor conveyance due to dispersion in supply), the convey interval of 90 mm is provided. In this case, the productivity regarding the recording sheet having A4 size becomes $$300\ [\mathrm{mm/s}]\times 60\ [\mathrm{s}]/(210\ [\mathrm{mm}]+90\ [\mathrm{mm}])/2\ [\mathrm{surfaces}]=30\ [\mathrm{sheets/min}].$$

Similarly, regarding various recording sheet having standard sizes, the convey interval of 90 mm is provided. In comparison with the productivity between the one surface recording, conventional both surface recording and the present invention both surface recording, results as shown in the following Table 1 were obtained.

TABLE 1

| | Productivity (sheets/min) | | | sheet interval in both surface printing | |
|---|---|---|---|---|---|
| Sheet size | one surface printing | both surface printing in prior art | both surface printing in present invention | prior art | present invention |
| A4 (210 mm) | 42 | 21 | 30 | 220 | 90 |
| B4 (364 mm) | 24 | 12 | 20 | 374 | 90 |
| A3 (420 mm) | 21 | 11 | 18 | 430 | 90 |

From the above Table 1, in the conventional case, the ratio of productivity of both surface recording with respect to one surface recording was 50%. To the contrary, the ratios of productivity in the present invention becomes as shown in the following Table 2.

TABLE 2

| | one surface printing | both surface printing in prior art | both surface printing in present invention |
|---|---|---|---|
| A4 | 100% | 50% | 71% |
| B4 | 100% | 50% | 83% |
| A3 | 100% | 50% | 85% |

As apparent from the above Table 2, in the both surface recording, the productivity can be improved greatly in comparison with the conventional case.

Incidentally, in the illustrated embodiment, while an example that the conveying intervals for various size sheets in the both surface recording are selected to be the same was explained, the optimum conveying interval may be selected for each size sheet. Further, while an example that the conveying speed of the recording sheet P1 is selected to be constant was explained, even when the conveying speed in the re-convey path D and the entire conveying speed for the re-conveyed sheet P2 are set to be faster, the effective result can be achieved by the present invention.

Further, in the illustrated embodiment, while the image forming apparatus of through path both surface type in which the front surface recording and the rear surface recording are effected alternately was explained. However, so long as the present invention is applied to image forming apparatuses in which a recording sheet on which an image was once formed is re-conveyed to an image forming means, effective result can be achieved. Accordingly, the present invention can be applied to image forming apparatuses of other both surface recording type or multi recording type (for example, batch processing through path type or intermediate tray type).

What is claimed is:

1. An image forming apparatus comprising:

electrophotographic image forming means for forming a toner image on a sheet;

fixing means for fixing the toner image formed on the sheet by heating the toner image;

sheet supply means for supplying sheets to said image forming means;

sheet supporting means for supporting sheets on which an image has been formed on a first surface; and re-convey means for returning sheets supported on the sheet supporting means to said image forming means to form an image on second surfaces of the sheets supported on the sheet supporting means;

wherein the sheets returned to the image forming means by said re-convey means and the sheets conveyed by said sheet supply means are conveyed to the image forming means alternately; and a sheet interval when sheets are alternately conveyed to said image forming means by said sheet supply means and said re-convey means is selected to be smaller than a sheet interval when sheets are continuously conveyed to said image forming means to form images on only one surface of each of the sheets.

2. An image forming apparatus according to claim 1, further comprising a first reverse mechanism disposed at a downstream side of said image forming means for discharging a sheet on which at least one image is recorded while reversing front/rear surface, and a second reverse mechanism disposed in said re-convey means which reverses front/rear surfaces of a sheet being returned by said re-convey means to said image forming means.

3. An image forming apparatus according to claim 2, wherein:

when sheets are continuously conveyed by said sheet supply means to said image forming means for forming images only on one side, sheets are discharged out of the image forming apparatus by said first reverse mechanism; and when sheets are alternately conveyed to said image forming means by said re-convey means and said sheet supply means, sheets are returned to said image forming means by said second reverse mechanism.

4. An image forming apparatus according to claim 1, wherein said sheet supply means comprises a pick-up roller for feeding out sheets from a sheet containing part, and a pair of separation rollers for separating the sheets fed out by said pick-up roller one by one.

5. An image forming apparatus according to claim 1, wherein said re-convey means has a through path for continuously conveying sheets on which an image has been formed on one surface to the image forming means.

6. An image forming apparatus according to claim 1, wherein said re-convey means has an intermediate tray on which sheets on which an image has been formed on one surface are temporarily contained.

* * * * *

UNITED STATES PATENT AND TRADEMARK OFFICE

CERTIFICATE OF CORRECTION

PATENT NO. : 6,275,676 B1
DATED : August 14, 2001
INVENTOR(S) : Kenji Ushio

It is certified that error appears in the above-identified patent and that said Letters Patent is hereby corrected as shown below:

Title page,
Item [57], ABSTRACT,
Line 9, "surfaces" should read -- surface --.

Column 1,
Line 34, "arising" should be deleted, and "lens." should read -- lens arising. --.

Column 4,
Line 60, "becomes." should read -- becomes --.

Column 6,
Line 23, "becomes" should read -- become --.

Signed and Sealed this

Fifth Day of March, 2002

*Attest:*

*Attesting Officer*

JAMES E. ROGAN
*Director of the United States Patent and Trademark Office*